US005185910A

United States Patent [19]

Ziaylek, Jr. et al.

[11] Patent Number: 5,185,910

[45] Date of Patent: Feb. 16, 1993

[54] REVERSIBLY RELEASABLE LATCHING APPARATUS

[75] Inventors: Theodore Ziaylek, Jr., 140 Riverview Dr.; Michael P. Ziaylek, 3 Brook La., both of Yardley, Pa. 19067

[73] Assignees: Theodore Ziaylek, Jr.; Michael P. Ziaylek, both of Yardley, Pa.

[21] Appl. No.: 835,885

[22] Filed: Feb. 14, 1992

[51] Int. Cl.[5] ..... A44B 11/25

[52] U.S. Cl. ..... 24/650

[58] Field of Search ..... 24/651, 643, 644, 647, 24/650, 646, 115 F, 603, 641

[56] References Cited

U.S. PATENT DOCUMENTS

| | | | |
|---|---|---|---|
| 988,078 | 3/1911 | Carter . | |
| 2,271,251 | 1/1942 | Buck . | |
| 2,287,721 | 6/1942 | Beazley . | |
| 2,458,810 | 1/1949 | Varney et al. . | |
| 2,602,977 | 7/1952 | Tannersjö . | |
| 2,684,513 | 7/1954 | Morse . | |
| 2,710,999 | 6/1955 | Davis | 24/650 X |
| 2,846,745 | 8/1958 | Lathrop . | |
| 2,876,516 | 3/1959 | Cummings . | |
| 2,893,088 | 7/1959 | Harper et al. . | |
| 3,049,778 | 8/1962 | Weckesser . | |
| 3,090,092 | 5/1963 | Sczemplak et al. | 24/650 X |
| 3,146,848 | 9/1964 | Gutshall | 24/603 X |
| 3,203,064 | 8/1965 | Murphy, Sr. | 24/650 |
| 3,313,573 | 4/1967 | Smith et al. . | |
| 3,579,750 | 5/1971 | Carbon | 24/650 |
| 4,477,949 | 10/1984 | Calabro . | |
| 4,624,034 | 11/1986 | Ishiguro et al. | 24/641 |
| 4,920,619 | 5/1990 | Bender et al. | 24/603 X |

FOREIGN PATENT DOCUMENTS

| | | | |
|---|---|---|---|
| 70520 | 8/1893 | Fed. Rep. of Germany | 24/647 |
| 21099 | of 1909 | United Kingdom | 24/647 |

*Primary Examiner*—James R. Brittain

*Attorney, Agent, or Firm*—Sperry, Zoda & Kane

[57] ABSTRACT

A latching apparatus including a tab member detachably securable with respect to a base and housing combination which includes a trigger assembly therein and an ejector assembly for selectively achieving securement or detachment of the tab member with respect to the housing as desired. The housing includes side walls defined in apertures through which a pin may extend upon which the trigger member is pivotally mounted with respect to the housing. The trigger member can be externally manipulated and is operable to selectively engage or disengage the latching slot of the tab. The trigger is biased into engagement with the latching slot of the tab by a trigger spring. An ejector including a notch defined therein is adapted to be selectively compressed by the tab when positioned in locking engagement within the tab channel and includes an injector spring to facilitate ejection of the tab from the tab channel when the trigger is moved to the disengaging position. Operation of the trigger to the disengaging position is achieved by movement in the same direction that the tab moves while being removed from the channel.

19 Claims, 2 Drawing Sheets

REVERSIBLY RELEASABLE LATCHING APPARATUS

BACKGROUND OF THE INVENTION

1. Field Of The Invention

The present invention is usable for providing a latching mechanism wherein quick release is required normally by the pulling of a lanyard or otherwise facilitating rapid release of a latching mechanism. This type of a latching mechanism is particularly usable in retaining tanks and other similar configurations with respect to fire trucks and other fire equipment. With such configurations it is desirable that the capability of quick and rapid release is one of the primary important characteristics of the design. Also the direction of operation of the release is important within the apparatus useful in this field of the invention since normally the locking tab exits from the locking latch in the same direction that the force will be exerted to effect release of that tab. This is an unusual configuration particularly useful in fire equipment apparatus.

2Description Of The Prior Art

Numerous buckling configurations or latching configurations have been designed in order to facilitate release of a secured latching device. However, none are similar to the construction claimed within the present application. Examples of such prior art are U.S. Pat. No. 988,078 issued Mar. 28, 1911 to R. Carter and assigned to The Perfection Harness And Tub Buckle Company on a Harnes-Buckel; U.S. Pat. No. 2,271,251 issued Jan. 27, 1942 to W. Buck on a Buckle For Belts; U.S. Pat. No. 2,287,721 issued Jun.23, 1942 to H. Beazley on a Buckle; U.S. Pat. No. 2,458,810 issued Jan. 11, 1949 to K. Varney et al on an Aviator's Belt; U.S. Pat. No. 2,602,977 issued Jul. 15, 1952 to N. Tannersjo and assigned to Gosta Wannstrom on a Buckle; U.S. Pat. No. 2,684,513 issued Jul. 27, 1954 to W. Morse and assigned to Morse-Andrews Co. on a Buckle; U.S. Pat. No. 2,846,745 issued Aug. 12, 1958 to W. Lathrop and assigned to Cummings & Sander on a Buckle; U.S. Pat. No. 2,876,516 issued Mar. 10, 1959 to L. Cummings on a Buckle; U.S. Pat. No. 2,893,088 issued Jul. 7, 1959 to W. harper et al and assigned to Automotive Safety Associates on a Safety Belt Buckle; U.S. Pat. No. 3,049,778 issued Aug. 21, 1962 to E. Weckesser on a Ratchet Buckle; U.S. Pat. No. 3,313,573 issued Apr. 11, 1967 to R. Smith et al and assigned to Chrysler Corporation on a Low Friction Seat Belt Release and U.S. Pat. No. 4,477,949 issued Oct. 23, 1984 to A. Calabro on a Belt Buckle Construction.

SUMMARY OF THE INVENTION

The present invention provides a reversibly releasable latching apparatus including a base fixedly attached with respect to a housing. The base and housing configuration is adapted to receive a tab member therein. Such tab member normally includes a latching slot defined therein to faciitate engagement thereof with respect to the housing and base construction.

The housing preferably defines a trigger opening or slot therein. The housing further includes side walls fixedly secured with respect to the base member such as to extend upwardly and outwardly away therefrom. The side walls define a tab channel means therein to facilitate movement therethrough of the tab member to aid in latching and unlatching thereof with respect to the housing for operation of the reversible releasable latching apparatus of the present invention.

The tab channel preferably defines a tab channel axis extending axially therethrough which defines the path of movement of the tab member with respect to the housing during engaging and disengaging thereof. The base member is preferably integrally formed with at least a portion of the side wall configuration to form an integral fixed member. The sidewalls further preferably define pin apertures for facilitating mounting of the trigger.

The housing may further include a top member extending over the side walls and in cooperative relationship with the base member and the side walls such that an internal chamber is defined therebetween. The top member and at least a portion of the side walls are integrally formed with respect to one another to facilitate the providing of a single unitary structure. The top member itself defines the trigger opening therethrough.

A trigger assembly is included having a trigger member pivotally mounted with respect to the housing such as to be movable pivotally between a releasing position and a securing position as desired. The trigger member may defined a pin opening means therethrough to facilitate this pivotal movement. A main trigger section is positioned preferably at all times within the internal chamber and is pivotally movable with respect to the housing to be selectively engageable with respect to the latching slot of the tab. The main section of the trigger also defines a trigger bore therein to facilitate engagement with the trigger biasing means or coil spring means.

The trigger member will also define a trigger arm section thereon which is fixed secured with respect to the trigger main section such as to extend obliquely away therefrom. The trigger arm section is preferably pivotally movable with respect to the main trigger section. The trigger arm section extends outwardly from the internal chamber through the trigger opening at an oblique angle with respect to the tab channel axis to facilitate urging of the trigger assembly between the releasing position and the securing position. The trigger arm section is responsive to force exerted thereon in a direction parallel to and in the same direction as the tab channel axis and away from the reversible releasable latching apparatus to release the trigger main section from engagement with respect to the tab member to further facilitate release of the tab member from the housing. This trigger arm section may further include an arm aperture therein to facilitate attachment of a lanyard or other attachment to facilitate movement of the trigger assembly to the releasing position.

A trigger biasing means such as a first coil spring may be positioned in operative abutting relationship with respect to the housing such that it extends into the trigger bore of the trigger member. This trigger biasing means is operative to bias the trigger member toward the securing position with the trigger main section being engaged with respect to the tab member extending into the tab channel defined by the side walls for facilitating retaining thereof within the tab channel.

A pin may also be included in the apparatus of the present invention extending through the pin aperture and through the pin opening to facilitate pivotal movement of the trigger member with respect to the housing. A pin securement means such as a retainment ring or the like may be attached to the pin means outside of the housing to facilitate retainment of the pin extending through the pin aperture A spacer may be positioned extending about the pin between the pin aperture and the pin opening to maintain spacing between the trigger and the housing.

An ejector assembly is also includes in the apparatus of the present invention which includes an ejector member pivotally movable with respect to the housing within the internal chamber and being in abutment with respect to the tab member when positioned extending through the tab channel. This ejector member defines an ejector notch therein adapted to engage the tab member to facilitate ejecting thereof responsive to force exerted against the ejector member by the ejector biasing spring. The ejector member may further define an ejector bore to facilitate engagement therewith. The ejector member is longitudinally movable within the internal chamber between an ejecting position and a retracted position in a direction axially parallel with respect to the tab channel axis.

An ejector biasing means such as a second coil spring may be operatively positioned in abutting engagement with respect to the housing and the ejector bore of the ejector member for biasing this ejector member toward the tab member when positioned extending through the tab channel means. This ejector biasing spring is adapted to eject the tab member from the tab channel means responsive to release of engagement of the trigger main section with respect to the tab member and in particularly the latching slot thereof responsive to movement of the trigger member to the releasing position.

An extension means can be attached with respect to the base which defines an attachment aperture therein to facilitate attachment of the reversibly releasable latching apparatus of the present invention with respect to surrounding environment structure.

It is an object of the present invention to provide a reversibly releasable latching apparatus in accordance with the present invention wherein maintenance costs are minimized.

It is an object of the present invention to provide a reversibly releasable latching apparatus in accordance with the present invention wherein a minimal number of moving parts are utilized.

It is an object of the present invention to provide a reversibly releasable latching apparatus in accordance with the present invention wherein initial capital cost outlay is minimized.

It is an object of the present invention to provide a reversibly releasable latching apparatus in accordance with the present invention wherein reliability of attachment is achieved.

It is an object of the present invention to provide a reversibly releasable latching apparatus in accordance with the present invention wherein speed of release is made extremely quick.

It is an object of the present invention to provide a reversibly releasable latching apparatus in accordance with the present invention wherein release failures are minimized.

It is an object of the present invention to provide a reversibly releasable latching apparatus in accordance with the present invention wherein release is achieved by movement of a releasing arm in the same direction that the locking tab exits at the time of release.

It is an object of the present invention to provide a reversibly releasable latching apparatus in accordance with the present invention wherein a strong efficiently operating latch can be made within a very small buckling size.

It is an object of the present invention to provide a reversibly releasable latching apparatus in accordance with the present invention wherein minimal time is required for engagement or disengagement of the latching mechanism.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
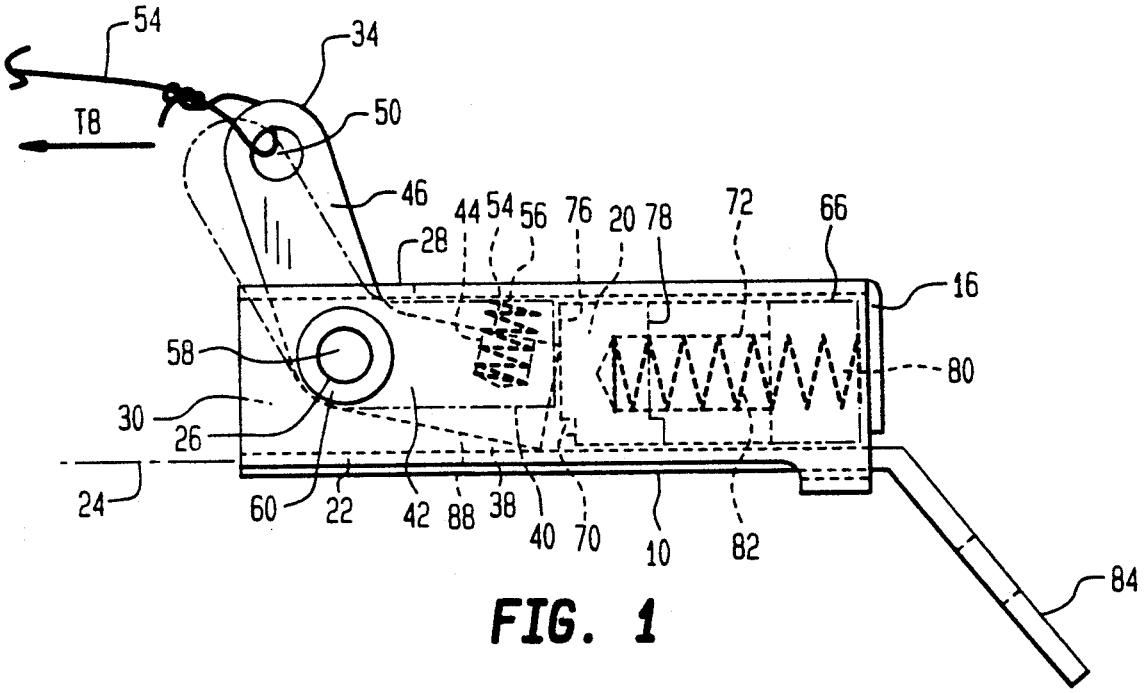
FIG. 1 is a side cross sectional view of an embodiment of the reversibly releasable latching apparatus of the present invention.

The present invention provides a reversibly releasable latching apparatus which includes a base member 10, side wall means 20 and a housing means 16 being fixedly interconnected with respect to one another to define therebetween an internal chamber 30. A tab member 12 which will normally be connected with respect to a retaining belt will be detachably securable with respect to the housing 16 by placement thereof into a tab channel means 22 defined within housing 16. Tab channel means 22 is adapted to receive the tab member 12 moved therein along the axis 24 of the tab channel. Engagement of the housing 16 with respect to the tab member 12 is enhanced by the positioning of a latching slot 14 within the tab member 12.

The housing 16 preferably includes not only the side walls 20 but also a top member 28 extending thereover. A trigger member 34 is preferably rotatably mounted upon a pin 58 by the definition of a pin opening means 40 therein. Pin opening means 40 defined within the trigger member 34 will facilitate pivotal movement of trigger 34 with respect to the housing 16. This trigger member 34 is movable between a position 36 wherein the tab member 12 is released and a securing position 38 wherein the tab member 12 is retained or secured within the tab channel means 22.

Figure 2:
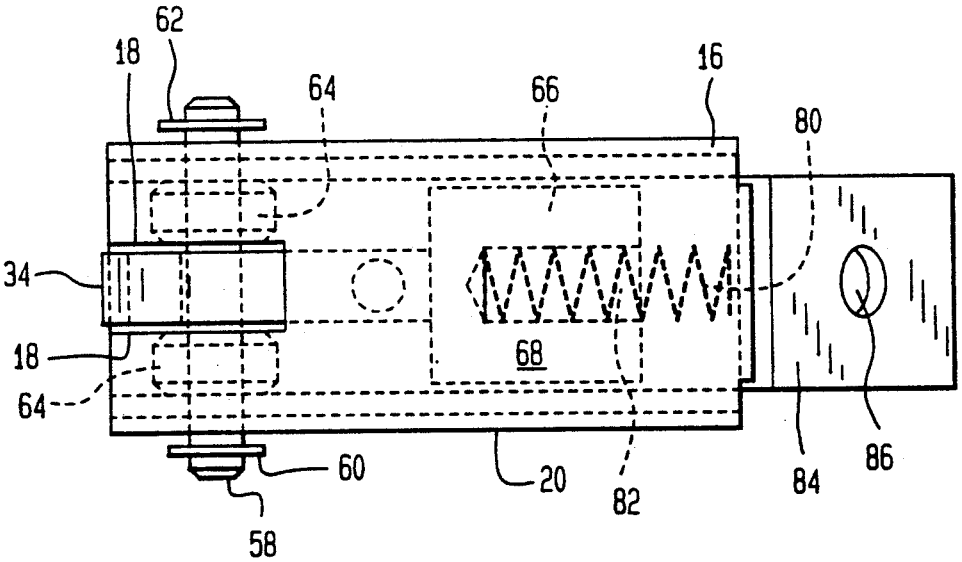
FIG. 2 is a top cross sectional view of an embodiment of the invention shown in FIG. 1.
Figure 3:
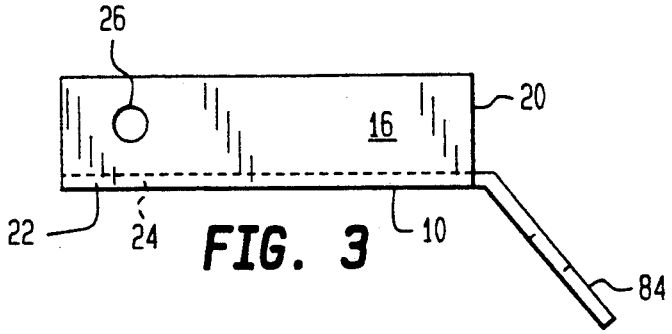
FIG. 3 is a side plan view of a base made in accordance with the embodiment of the invention shown in FIG. 1.
Figure 4:
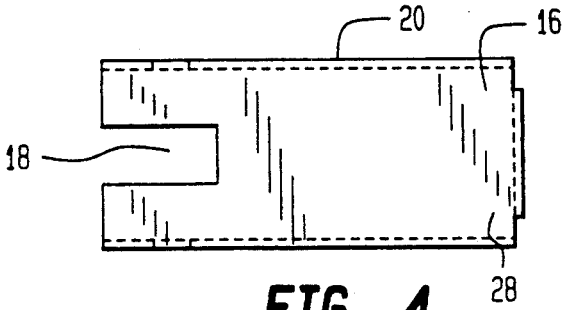
FIG. 4 is a top plan view of the housing made in accordance with the embodiment of the invention shown in FIG. 1.
Figure 5:
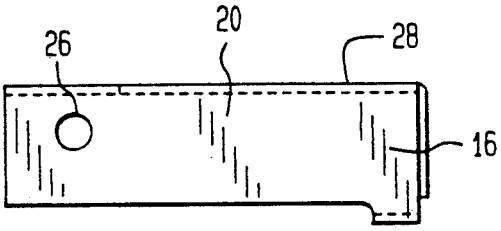
FIG. 5 is a side plan view of the housing made in accordance with the embodiment of the invention shown in FIG. 1.
Figure 6:
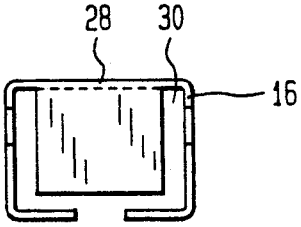
FIG. 6 is an end plan view of the housing made in accordance with the embodiment of the invention shown in FIG. 1.
Figure 7:
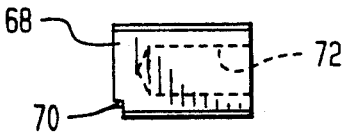
FIG. 7 is a side plan view of the ejector made in accordance with the embodiment of the invention shown in FIG. 1.
Figure 8:
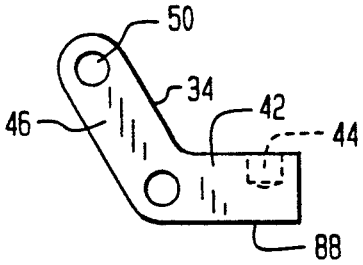
FIG. 8 is a side plan view of the trigger member made in accordance with, the embodiment of the invention shown in FIG. 1.
Figure 9:
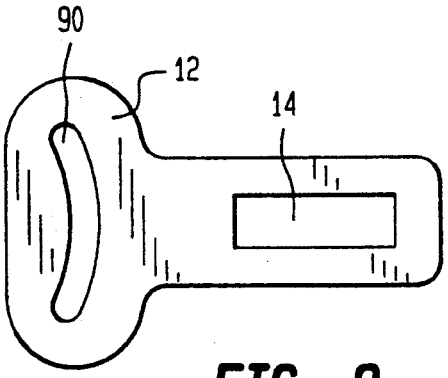
FIG. 9 is a top plan view of the tab member made in accordance with the embodiment of the invention shown in FIG. 1.

The trigger member 34 preferably includes a trigger main section 42 maintained within the housing 16 and a trigger arm section 46 adapted to extend outside of the housing. Trigger arm section is adapted to extend through the trigger opening 18 defined in the top member 28 of housing 16. Preferably the trigger will extend outwardly at an oblique angle with respect to the top member 28 as well as an oblique angle with respect to the trigger main section 42. With this configuration preferably the pin means 58 will extend through the pin opening means 40 in trigger 34 and will then extend through the pin aperture means 26 defined in the side walls 20. In this manner the trigger member 34 will be mounted for pivotal movement with respect to the housing 16. To facilitate the maintenance or orientation of the trigger member centrally along the pin 58, a spacer means 64 can be positioned on each side of pin 58 between the side wall 20 and the pin 58 as best shown in FIG. 2. The pin 58 may be retained in position by the use of a pin securement means 60 such as a retainment ring 62 affixed to the outermost opposite ends thereof.

The trigger will preferably include trigger biasing means 54 within the assembly thereof which may include a first coil spring means 56 adapted to abut the undersurface of top member 28 and adapted to extend into a trigger bore 44 defined within the trigger main section 42. With this configuration the trigger biasing means 54 will be adapted to urge the trigger main section 42 downwardly into engagement with respect to a tab member 12 and particularly with engagement with respect to a latching slot 14 defined therein.

An ejector assembly 66 will also be utilized in the present invention which includes an ejector member 68 positioned within the internal chamber 30 in such a manner as to allow longitudinal movement thereof. The ejector member 68 will preferably include an ejector notch 70 adapted to directly engage a tab member 12 when positioned within the tab channel 22 in such a manner as to facilitate ejection thereof as desired. Movement of the ejector member 68 is controlled by an ejector biasing means 80 which is in abutment with respect to one end of the housing 16 and in particular with respect to the side wall means 20 thereof with the other end thereof extending into the ejector bore 72 defined on the ejector member 68. This ejector biasing means 80 will preferably comprise a second coil spring means 82.

The movement of the ejector member 68 would be between an ejected position 76 and retracted position 78. Movement to the ejected position 76 is controlled by the ejector biasing means 80. When the tab member 12 is placed into the tab channel 22 the ejector member 68 will be moved to the right as shown in FIG. 1 until it the tab member 12 is locked in place with the trigger main section 42 extending through the latching slot 14 wherein the ejector member 68 will then be in the retracted position 78.

The trigger arm 46 of the trigger assembly may include an arm aperture 50 defined therein to facilitate control of movement of the trigger arm. Furthermore a lanyard 52 or other device may be secured with respect to the arm aperture 50 to facilitate control of movement thereof.

Securement of the reversibly releasable latching apparatus of the present invention with respect to the surrounding environmental structure can be facilitated by the inclusion of the base extension means 84 which may include an attachment aperture 86 defined thereon. This attachment aperture 86 can be attached to a mounting bracket or other similar retaining structure.

In order to latch the reversible releasable latching apparatus of the present invention the tab member 12 will be caused to enter into the tab channel means 22 along tab channel axis 24 from the right as shown in FIG. 1. With this configuration the end of the tab member 12 will engage the ejector slot 70 of ejector member 68 thereby moving the ejector member to the right as shown in FIG. 1 and compressing of the ejector spring 82. At the same time the tab means will contact the lower surface 88 of the trigger main section 42 such as to cause movement of the trigger member toward the releasing position 36 thereof.

As the tab member 12 is moved inwardly the latching slot 14 thereof obviously is also moved inwardly. As soon as the latching slot 14 becomes aligned with respect to the trigger main section 42 the trigger biasing spring 56 will cause the trigger main section 42 to enter the latching slot 44 in registered position immediately therebelow. This will cause slight clockwise rotation of the trigger member 34 about the axis of pin means 58. At this point a bias will be exerted against the tab member 12 by the ejector assembly 66 attempting to urge the tab 12 to exit from the housing 16. This exit will however be impossible since the trigger main section 42 will be extending into the latching slot 14 thereby retaining the tab 12 within the tab channel 22.

Release of the reversibly releasable latching apparatus of the present invention is achieved by a user by pulling for example on lanyard 52 in the direction 48 shown in FIG. 1. Thus we see that force exerted upon the trigger member 34 in the direction directly to the left as shown in FIG. 1 will cause slight counterclockwise rotation of the trigger member 34 and will remove engagement between the trigger main section 42 and the latching slot 14 of tab member 12. This will allow the stored energy of the ejector member 68 as urged by the ejector spring 82 to push the tab member 12 outwardly or to the left as shown in FIG. 1 to exit the tab channel 22 thereby effecting release. Thus we see that the tab being released travels in the same direction that the force was originally exerted through lanayrd 52 on the trigger mechanism to initiate this release.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein re intended to be illustrative only and not intended to limit the scope of the invention.

I claim:

1. A reversibly releasable latching apparatus having a notched ejector member comprising:

A. a base member;

B. a tab member being movable with respect to said base member;

C. a housing means defining a trigger opening therein and including:

(1) side wall means fixedly secured with respect to said base member and extending therefrom, said side wall means further defining a tab channel means therein to facilitate movement therethrough of said tab member to facilitate latching and unlatching thereof with respect to said housing means for operation of said reversibly releasable latching apparatus, said tab channel means defining a tab channel axis extending axially therethrough defining the path of movement of said tab member with respect to said housing means during engaging and disengging thereof with respect thereto: and (2) a top member extending over said side wall means and in cooperative relationship with respect to said base member and said side wall means defining an internal chamber therebetween;

D. a trigger assembly means including;

(1) a trigger member pivotally mounted with respec to said housing means to be pivotally movably between a releasing position and a securing position;

(a) a trigger main section located within said internal chamber and being pivotally moveable with respect to said housing means to be selectively engageable with respect to said tab means;

(b) a trigger arm section fixedly secured with respect to said trigger main section and pivotally moveable therewith, said trigger arm section extending outwardly from said internal chamber through said trigger opening to facilitate urging of said trigger assembly between the releasing position and the securing position, said trigger arm section being responsive to force exerted theroen in a direction parallel to said tab channel axis and away from said reversibly releasable latching apparatus to release said trigger main section from engagement with respect to said tab member for facilitating release of said tab member with respect to said housing means;

(2) a trigger biasing means in operative abutting relationship with respect to said housing means and said trigger member and being operative to bias said trigger member toward the securing position with said trigger main section being engageable with respect to said tab member extending into said tab channel means defined by said side wall means for facilitating retaining thereof within said tab channel means;

E. an ejector assembly means including;

(1) an ejector member being movably positioned with respect to said housing means within said internal chamber thereof and being in abutment with respect to said tab member when positioned extending through said tab channel means, said ejector member defining an ejector notch therein adapted to engage said tab member to facilitate ejecting thereof responsive to force urged against said ejector member by said ejector biasing means; and (2) an ejector biasing means operatively in abutting relationship with respect to said housing means and said ejector member for biasing said ejector member toward said tab member when positioned extending through said tab channel means, said ejector biasing means adapted to eject said tab member from said tab channel means responsive to release of engagement of said trigger main section with respect to said tab member responsive to movement of said trigger member to the releasing position.

2. A reversibly releasable latching apparatus having a notched ejector member as defined in claim 1 wherein said top member and at least a part of said wall means are integrally formed with respect to one another.

3. A reversibly releasable latching apparatus having a notched ejector member as defined in claim 1 wherein said base member and at least a part of said wall means are integrally formed with respect to one another.

4. A reversibly releasable latching apparatus having a notched ejector member as defined in claim 1 wherein said trigger arm section is obliquely oriented with respect to said trigger main section.

5. A reversibly releasable latching apparatus having a notched ejector member as defined in claim 1 wherein said trigger arm section extends out of said internal chamber at an oblique angle with respect to said tab channel axis.

6. A reversibly releasable latching apparatus having a notched ejector member as defined in claim 1 wherein said side wall means defines pin aperture means therethrough and said trigger member defining a pni openign emans therethrough and wherein said trigger assembly further comprises a pin means extending through said pin aperture means and said pin opening means to facilitate pivotal movement of said trigger member with respect to said housing means.

7. A reversibly releasable latching apparatus having a notched ejector member as defined in claim 6 wherein said trigger assembly further includes pin securement means attached to said pin means outside of said housing to facilitate retainment of said pin means extending through said pin aperture means.

8. A reversibly releasable latching apparatus having a notched ejector member as defined in claim 7 wherein said pin securement means comprises a retaining ring means.

9. A reversibly releasable latching apparatus having a notched ejector member as defined in claim 6 further comprising spacer means positioned extending about said pin means between said pin aperture means and said pin opening means to maintain spacing between said trigger means and said housing means.

10. A reversibly releasable latching apparatus having a notched ejector member as defined in claim 1 further comprising a base extension means defining an attachment aperture therein to facilitate attachment of said reversibly releasable latching apparatus with respect to environmental structure as desired.

11. A reversibly releasable latching apparatus having a notched ejector member as defined in claim 1 wherein said trigger opening is defined in said top member.

12. A reversibly releasable latching apparatus having a notched ejector member as defined in claim 1 wherein said trigger main section defines a trigger bore therein to facilitate abutment of said trigger biasing means therewith.

13. A reversibly releasable latching apparatus having a notched ejector member as defined in claim 12 wherein said trigger biasing means comprises a first coil spring means in abutment with respect to said housing means and extending into said trigger bore of said trigger main section to facilitate abutting engagement therewith.

14. A reversibly releasable latching apparatus having a notched ejector member as defined in claim 1 wherein said ejector member defines an ejector bore therein to facilitate abutment of said ejector biasing means therewith.

15. A reversibly releasable latching apparatus having a notched ejector member as defined in claim 14 wherein said ejector biasing means comprises a second col spring means in abutment with respect to said side wall means and extending into said ejector bore of said ejector member to facilitate abutting engagement therewith.

16. A reversibly releasable latching apparatus having a notched ejector member as defined in claim 1 wherein said tab member defines a latching slot therien adapted to receive at least a part of said trigger main section extending therein to facilitate engagement therewith responsive to said tab mebmer being positioned extending into said tab channel means.

17. A reversibly releasable latching apparatus having a notched ejector member as defined in claim 1 wherein said ejector member is longitudinally movable within said internal chamber between an ejecting position and a retracted position in a direction axially parallel with respect to said tab channel axis.

18. A reversibly releasable latching apparatus having a notched ejector member as defined in claim 1 wherein said trigger arm section includes an arm paerture defined therein to facilitate attachment of a lanyard thereto to facilitate movement of said trigger assembly to the releasing position.

19. A reversibly releasable latching apparatus having a notched ejector member comprising:

A. a base member;

B. a tab member being movable with respect to said base member, said tab member defining a latching slot therein to facilitate engagement therewith;

C. a housing means defining a trigger opening therein and including:

(1) side wall means fixedly secured with respect to said base member and extending therefrom, said side wall means further defining a tab channel means therein to facilitate movement therethrough of said tab member to facilitate latching and unlatching thereof with respect to said housing means for operation of said reversibly releasable latching apparatus, said tab channel means defining a tab channel axis extending axially therethrough defining the path of movement of said tab member with respect to said housing means during engaging and disengging thereof with respect thereto, said base member and at least a portion of said side wall means being integrally formed with respect to one another, said side wall means further defining pin aperture means therethrough; and (2) a top member extending over said side wall means and in cooperative relationship with respect to said base member and said side wall means defining an internal chamber therebetween, said top member and at least a portion of said side wall means being integrally formed with respect to one another, said top member defining said trigger opening therethrough;

D. a trigger assembly means including;

(1) a trigger member pivotally mounted with respec to said housing means to be pivotally movably between a releasing position and a securing position, said trigger member defining a pin opening means therethrough to further facilitate movement thereof;

(a) a trigger main section located within said internal chamber and being pivotally moveable with respect to said housing means to be selectively engageable with respect to said latching slot means to said tab means, said trigger main section defining a trigger bore therein;

(b) a trigger arm section fixedly secured with respect to said trigger main section and extending obliquely away therefrom, said trigger arm section being pivotally moveable with said trigger main section, said trigger arm section extending outwardly from said internal chamber through said trigger opening at an oblique angle with respect to said tab channel axis to facilitate urging of said trigger assembly between the releasing position and the securing position, said trigger arm section being responsive to force exerted thereon in a direction parallel to said tab channel axis and away from said reversibly releasable latching apparatus to release said trigger main section from engagement with respect to said tab member for facilitating release of said tab member with respect to said housing means, said trigger arm section further defining an arm aperture therein to facilitate attachment of a lanyard thereto to facilitate movement of said trigger assembly to the releasing position.

(2) a trigger biasing means comprising a first coil spring means in operative abutting relationship with respect to said housing means and extending into said trigger bore of said trigger member, said trigger biasing means operative to bias said trigger member toward the securing position with said trigger main section being engageable with respect to said tab member extending into said tab channel means defined by said side wall means for facilitating retaining thereof within said tab channel means;

(3) a pin means extending through said pin aperture means and said pin opening means to facilitate pivotal movement of said trigger member with respect to said housing means;

(4) pin securement means including a retainment ring means attached to said pin means outside of said housing to facilitate retainment of said pin means extending through said pin aperture means;

(5) a spacer means positioned extending about said pin means between said pin aperture means and said pin opening means to maintain spacing between said trigger means and said housing means;

E. an ejector assembly means including;

(1) an ejector member being movably positioned with respect to said housing means within said internal chamber thereof and being in abutment with respect to said tab member when positioned extending through said tab channel means, said ejector member defining an ejector notch therein adapted to engage said tab member to facilitate ejecting thereof responsive to force urged against said ejector member by said ejector biasing means, said ejector member further defining an ejector bore, said ejector emmber being longitudinally moveable within said internal chamber between an ejecting position and a retracted position in a direction axially parallel with respect to said tab channel axis;

(2) an ejector biasing means comprising a second coil spring means operatively in abutting relationship with respect to said housing means and said ejector bore of said ejector member for biasing said ejector member toward said tab member when positioned extending through said tab channel means, said ejector biasing means adapted to eject said tab member from said tab channel means responsive to release of engagement of said trigger main section with respect to said tab member responsive to movement of said trigger member to the releasing positin; and F. a base extension means defining an attachment aperture therein to facilitate attachment of said reversibly releasable latching apparatus with respect to environmental structure as desired.

* * * * *

UNITED STATES PATENT AND TRADEMARK OFFICE

CERTIFICATE OF CORRECTION

PATENT NO. : 5,185,910

DATED : February 16, 1993

INVENTOR(S) : Theodore Ziaylek, Jr. and Michael P. Ziaylek

It is certified that error appears in the above-identified patent and that said Letters Patent is hereby corrected as shown below:

In column 7, line 7, change "disengging" to -- disengaging --.

In column 7, lines 15-16, change "respec" to -- respect --.

In column 8, line 24, change "emans" to -- means --.

In column 9, line 6, change "col" to -- coil --.

In column 9, line 15, change "mebmer" to -- member --.

In column 9, line 25, change "paerture" to -- aperture --.

In column 9, line 48, change "disengging" to -- disengaging --.

In column 9, lines 63-64, change "respec" to -- respect --.

In column 10, line 5, change "to" to -- of --.

In column 10, line 63, change "urged" to -- exerted --.

In column 10, line 66, change "emmber" to -- member --.

In column 12, line 4, change "positin" to -- position --.

UNITED STATES PATENT AND TRADEMARK OFFICE

CERTIFICATE OF CORRECTION

PATENT NO. : 5,185,910

DATED : February 16, 1993

INVENTOR(S) : Theodore Ziaylek, Jr. et al

It is certified that error appears in the above-indentified patent and that said Letters Patent is hereby corrected as shown below:

Column 8, line 23 change "pni" to --pin--.

Column 8, line 23 change "openign" to --opening--.

Signed and Sealed this

Eighteenth Day of January, 1994

*Attest:*

Bruce Lehman

BRUCE LEHMAN

*Attesting Officer*

*Commissioner of Patents and Trademarks*